United States Patent [19]

Tenhover et al.

[11] Patent Number: 4,557,766

[45] Date of Patent: Dec. 10, 1985

[54] BULK AMORPHOUS METAL ALLOY OBJECTS AND PROCESS FOR MAKING THE SAME

[75] Inventors: Michael A. Tenhover; Richard S. Henderson, both of Solon; Robert K. Grasselli, Aurora, all of Ohio

[73] Assignee: Standard Oil Company, Cleveland, Ohio

[21] Appl. No.: 586,467

[22] Filed: Mar. 5, 1984

[51] Int. Cl.[4] ..... B22F 3/24

[52] U.S. Cl. ..... 148/11.5 P; 148/403

[58] Field of Search ..... 148/11.5 P, 403; 75/251, 0.5 R, 0.5 A, 0.5 AA

[56] References Cited

U.S. PATENT DOCUMENTS 4,197,146 4/1980 Frischmann ..... 75/251

4,282,034 8/1981 Smith et al. ..... 75/251

*Primary Examiner*—Wayland Stallard

[57] ABSTRACT

Amorphous metal alloy shapes are synthesized by providing an intimate mixture of the components of the amorphous alloy, which mixture includes at least one ductile component. The mixture may be subjected to well-known forming techniques at a temperature below the crystallization temperature of the amorphous metal alloy to be formed. The ductile component of the mixture acts as a binder matrix to provide strength and uniform properties to the formed object.

13 Claims, No Drawings

BULK AMORPHOUS METAL ALLOY OBJECTS AND PROCESS FOR MAKING THE SAME

FIELD OF THE INVENTION

This invention relates to amorphous metal alloy shapes and the novel preparation of such shapes. More specifically, this invention relates to the synthesis of amorphous metal alloy shapes by solid state reactions that utilize a ductile matrix precursor.

BACKGROUND OF THE INVENTION

Amorphous metal alloy materials have become of interest in recent years due to their unique combinations of mechanical, chemical and electrical properties that are especially well-suited for newly-emerging applications. Examples of amorphous metal material properties include the following:

uniform electronic structure,
compositionally variable properties,
high hardness and strength,
flexibility,
soft magnetic and ferroelectronic properties,
very high resistance to corrosion and wear,
unusual alloy compositions, and
high resistance to radiation damage.

These characteristics are desirable for applications such as low temperature welding alloys, magnetic bubble memories, high field superconducting devices and soft magnetic materials for power transformer cores.

The unique combination of properties of amorphous metal alloy materials may be attributed to the disordered atomic structure of amorphous materials which ensures that the material is chemically homogeneous and free from the extended defects that are known to limit the performance of crystalline materials.

Generally, amorphous materials are formed by rapidly cooling the material from a molten state. Such cooling occurs at rates on the order of $10^6$° C./second. Processes that provide such cooling rates include sputtering, vacuum evaporation, plasma spraying and direct quenching from the liquid state. Direct quenching from the liquid state has found the greatest commercial success since a variety of alloys are known that can be manufactured by this technique in various forms such as thin films, ribbons and wires. U.S. Pat. No. 3,856,513 to Chen et al. describes novel metal alloy compositions obtained by direct quenching from the melt and includes a general discussion of this process. Chen et al. describes magnetic amorphous metal alloys formed by subjecting the alloy composition to rapid cooling from a temperature above its melting temperature. A stream of the molten metal is directed into the nip of rotating double rolls maintained at room temperature. The quenched metal, obtained in the form of a ribbon, was substantially amorphous as indicated by x-ray diffraction measurements, was ductile, and had a tensile strength of about 350,000 psi.

U.S. Pat. No. 4,036,638 to Ray et al. describes binary amorphous alloys of iron or cobalt and boron. The claimed amorphous alloys were formed by a vacuum melt-casting process wherein molten alloy was ejected through an orifice and against a rotating cylinder in a partial vacuum of about 100 millitorr. Such amorphous alloys were obtained as continuous ribbons and all exhibited high mechanical hardness and ductility.

The thicknesses of essentially all amorphous foils and ribbons formed by rapid cooling from the melt are limited by the rate of heat transfer through the material. Generally the thicknesses of such films are less than 50 μm. The few materials that can be prepared in this manner include those disclosed by Chen et al. and Ray et al.

Amorphous metal alloy materials prepared by electrodeposition processes have been reported by Lashmore and Weinroth in Plating and Surface Finishing, 72 (August 1982). These materials include Co-P, Ni-P, Co-Re and Co-W compositions. However, the as-formed alloys are inhomogeneous and so can be used in only limited applications.

The above-listed prior art processes for producing amorphous metal alloys depend upon controlling the kinetics of the solidification process; controlling the formation of the alloy from the liquid (molten) state or from the vapor state by rapidly removing heat energy during solidification. The known amorphous metal alloys and processes for making such alloys discussed above suffer from the disadvantage that the so-formed amorphous alloy is produced in a limited form, that is, as a thin film such as a ribbon, wire or platelet. These limited shapes place severe restrictions on the applications for which amorphous metal materials may be used.

To produce bulk amorphous metal alloy objects the formed amorphous alloy must be mechanically and physically reduced to a powder as by chipping, crushing, grinding and ball milling, and then recombined in the desired shape. These are difficult processes when it is realized that most amorphous metal alloys have high mechanical strengths and also possess high hardnesses.

In Applicants' co-pending U.S. patent application, Ser. No. 586,380, filed Mar. 5, 1984, entitled "Amorphous Metal Alloy Powders and Synthesis of Same By Solid State Decomposition Reactions", there is disclosed a novel process by which amorphous metal alloys may be synthesized as powders. This process is a solid state reaction that produces an intimate mixture of the components of the amorphous metal alloy powders from precursor compounds. The above disclosure is incorporated herein by reference.

We have now discovered an improvement for the formation of amorphous bulk objects. It is therefore, one object of this invention to provide novel bulk amorphous metal alloy objects.

It is another object of the present invention to provide a process for the synthesis of bulk amorphous metal alloy objects.

These and additional objects of the present invention will become apparent in the description of the invention and examples that follow.

SUMMARY OF THE INVENTION

The present invention relates to a process for the production of substantially amorphous metal alloy objects comprising:

(a) preparing an intimate mixture of the components of the amorphous metal alloy by solid state reactions, at least one component of the intimate mixture being a ductile component; and (b) forming the intimate mixture into an object at a temperature below the crystallization temperature of the metal alloy so as to form an amorphous metal alloy object.

The present invention also relates to novel, substantially amorphous metal alloy objects synthesized in accordance with the above-summarized process.

DETAILED DESCRIPTION OF THE INVENTION

In accordance with this invention, there are provided novel, substantially amorphous metal alloy objects and a process for the production of such substantially amorphous metal alloy objects. The term "substantially" as used herein in reference to the amorphous metal alloy means that the metal alloys are at least fifty percent amorphous. Preferably the metal alloy is at least eighty percent amorphous and most preferably about one hundred percent amorphous, as indicated by x-ray diffraction analysis. The use of the phrase "amorphous metal alloys" herein refers to amorphous metal-containing alloys that may also comprise non-metallic elements. Amorphous metal alloys may include non-metallic elements such as boron, carbon, nitrogen, silicon, phosphorus, arsenic, germanium and antimony.

Amorphous metal alloys are generally characterized as having high strengths and hardnesses and so are quite resistant to deformation. Typical amorphous shapes, such as ribbons and wires, are formed simultaneously with the formation of the amorphous state. These shapes exhibit the characteristics of an amorphous material. However, attempts to form bulk amorphous shapes, that is, shapes having significant thicknesses in all dimensions, have not been satisfactory. These attempts generally include reducing an amorphous metal alloy, such as a ribbon, to an amorphous powder by physical means and then compacting the powder into a shape. Generally, the compacted shape does not retain all the desirable traits of the individual particles.

Applicants' copending patent application teaches the synthesis of amorphous metal alloy powders by solid state reactions. Applicants' above-identified disclosure includes a step whereby an intimate mixture of the components of the amorphous metal alloy is synthesized. Such an intimate mixture comprises particles having a maximum particle size of from about 10 Angstroms to about 1,000 Angstroms, and preferably from about 10 Angstroms to about 500 Angstroms. This intimate mixture can be obtained in a state that is not amorphous.

The intimate mixture as formed from the solid state reaction, will exhibit amorphous characteristics after a subsequent heat treatment at a temperature below the crystallization temperature of the metal alloy to be formed. Solid state reactions that produce such intimate mixtures include the thermal decomposition reactions described in Applicants' copending patent application and may also include other reactions such as chemical reduction reactions.

Whereas Applicants' referenced process teaches the synthesis of amorphous metal alloy powders, it has now been discovered that, in accordance with the invention claimed herein, that the intimate mixture obtained as an intermediate in the formation of Applicants' amorphous metal alloy powders may be effectively formed into bulk objects when at least one component of the intimate mixture is ductile. By ductile is meant a component that is malable, pliant and easily molded without cracking or fracturing. A typical ductile component will demonstrate deformation of at least ten percent under a moderate load of between about 1,000 psi and 5,000 psi. The ductile component of the intimate mixture provides an infrastructure that, when subjected to forming processes, deforms and binds the other components of the alloy within a matrix.

The ductile component of the alloy originates in a precursor compound that is used in the solid state reactions to form the intimate mixture of the alloy components. Examples of ductile components include pure metal elements, such as iron, nickel, copper, cobalt and tantalum, and metal solid solutions. Preferably the ductile component is a pure metal element.

To provide enhanced bonding strength and properties to the formed amorphous metal alloy object, it is preferred that the ductile component comprise from about 10 atomic percent to about 95 atomic percent of the amorphous metal alloy based on the total composition of the amorphous metal alloy.

An amorphous metal alloy composition that includes a ductile component in accordance with the invention disclosed herein may be represented by the following formulae:

$$M_aX_{1-a}$$

wherein

M is at least one metal selected from the metals in Groups VI-B, VII-B, VIII, I-B, IIB and IIIB of the Periodic Table; and X is at least one element selected from Groups III-A, IV-A and V-A of the Periodic Table; and wherein a ranges from about 0.1 to about 0.9; and $$N_bY_{1-b}$$

wherein

N is at least one metal selected from the metals in Groups III-B, IV-B, V-B and VI-B of the Periodic Table; and Y is selected from the metals in Group VIII of the Periodic Table; and wherein b ranges from about 0.2 to about 0.8

The intimate mixture of the components of the amorphous metal alloy, which has not yet been heat-treated to induce the amorphous state is subjected to a forming process. Forming processes include well-known powder forming techniques such as cold-pressing, hot-pressing, pressureless sintering, slipcasting, injection molding and extrusion. In accordance with this invention, the only restriction on the forming process is that the process be performed at a temperature below the crystallization temperature of the metal alloy.

If the forming process includes the use of temperature above ambient temperature, then the intimate mixture may be formed and made amorphous simultaneously. If the forming process does not include elevated temperatures, then a further step, heat-treating, will be required to induce the amorphous state.

Many intimate mixtures may be reactive with oxygen, and so, may require forming and heat-treating processing which occurs in an oxygen-free atmosphere such as an inert, reducing or reactive atmosphere or under vacuum conditions. A reactive atmosphere may be provided that reacts with the bulk object so as to enhance the formation of the amorphous alloy.

Amorphous metal alloy shapes generally have a density of from about 10 percent to about 99 percent of theoretical. The density may be controlled by the forming process so as meet a variety of needs. Thus, the same amorphous metal alloy composition may be formed into an amorphous metal alloy shape having a density between about 10 percent and about 90 percent of theoretical. It has also been observed that the process of this invention permits the attainment of a desired-density object at temperatures lower than those necessary to achieve the same sintered state when the metal alloy powder used to form the object is derived from the physical reduction of a prior art, thin-film amorphous shape such as a ribbon.

The forming process may be used to provide an amorphous metal alloy in a finished shape or in a solid shape amenable to further machining. Thus, billits, rods, flatplates may be formed as well as cylindrical shapes, toroids and other intricate, finished shapes.

The above-described invention provides a direct and economical means for the synthesis of amorphous metal alloy shapes. The above-described process for synthesizing amorphous metal alloy shapes is not hindered by the processing limitations of prior art processes. The method disclosed herein does not depend on reducing an amorphous material to a powder state and then recombining an amorphous powder but utilizes an intimate mixture of the components of a metal alloy into a bulk shape and thereafter, or concurrently, inducing the amorphous state by heat treating at a temperature below the crystallization temperature of the metal alloy.

EXAMPLE

The following example is presented to more thoroughly illustrate the invention and is not intended, in any way, to be limitative thereof.

This example demonstrates the formation of a solid shape having amorphous characteristics and an approximate composition of $Fe_2Ni_2B$.

In this Example, an intimate mixture of the components of the amorphous metal alloy was obtained by a chemical reduction process.

Equimolar amounts of iron chloride, $FeCl_2.4H_2O$, and nickel chloride, $NiCl_2.6H_2O$, were dissolved in distilled water to form a reaction solution. This solution was degassed with argon so as to purge oxygen from the solution. An argon-degassed solution of sodium borohydride, $NaBH_4$, was then added dropwise to the reaction solution. The solution was stirred for about sixteen hours to insure that the reaction had gone to completion.

A black precipitate was recovered from the solution and dried at about 60° C. under vacuum. This precipitate was an intimate mixture of the components of the metal alloy to be formed. The intimate mixture comprised iron metal and nickel boride. The pure iron metal is the ductile component of the mixture.

This powder mixture was kept under an argon atmosphere to prevent oxidation and compacted into a disc having a diameter of about 1 cm and a thickness of about 0.1 cm at a pressure of about 10,000 psi and at about 20° C. The disc was sealed in an evacuated glass tube and heat treated at about 250° C. for about 312 hours.

X-ray diffraction analysis revealed that the resultant disc was a solid amorphous metal alloy having a composition of about $Fe_2Ni_2B$. This disc had a density that was about 98 percent of theoretical.

The formation of amorphous metal alloy shapes could only be formed previously by first reducing an already-amorphous material into a powder and then compacting the powder. Such a process is not desirable since it inherently is energy intensive and cannot reliably produce consistent, homogeneous amorphous shapes. The disadvantages of the prior art are removed with the above-described process.

The selection of solid state reactions to produce the intimate mixture of components of the alloys, the choice of ductile components, the forming process and conditions can be determined from the preceeding Specification without departing from the spirit of the invention herein disclosed and described. The scope of the invention is intended to include modifications and variations that fall within the scope of the appended claims.

We claim:

1. A process for the production of substantially amorphous metal alloy objects comprising:

(a) preparing an intimate mixture of the components of the amorphous metal alloy by a solid state reaction, at least one component of the intimate mixture being a ductile component; and (b) forming the intimate mixture into an object at a temperature below the crystallization temperature of the metal alloy so as to form an amorphous metal alloy object.

2. The process in accordance with claim 1 wherein said intimate mixture comprises particles having a maximum particle size of from about 10 Angstroms to about 1000 Angstroms.

3. The process in accordance with claim 1 wherein said intimate mixture comprises particles having a maximum particle size of from about 10 Angstroms to about 500 Angstroms.

4. The process in accordance with claim 1 wherein said ductile component is a material selected from the group comprising pure metal elements and metal solid solutions.

5. The process in accordance with claim 1 wherein said ductile component is a metal element selected from the group comprising iron, nickel, copper, cobalt and tantalum.

6. The process in accordance with claim 1 wherein said ductile component comprises from about 10 atomic percent to about 95 atomic percent of the amorphous metal alloy based on the total composition of the amorphous metal alloy.

7. The process in accordance with claim 1 wherein step (b) comprises the step of forming the intimate mixture into an object followed by heat treating the so-formed object so as to induce the amorphous state.

8. The process in accordance with claim 1 wherein said process occurs under a reactive atmosphere.

9. The process in accordance with claim 1 wherein said process occurs under an inert atmosphere.

10. A substantially amorphous metal alloy object having a ductile component comprising from about 10 atomic percent to about 95 atomic percent of the amorphous metal alloy based on the total composition of the amorphous metal alloy, said object synthesized by forming an intimate mixture of the components of the amorphous metal alloy from particles having a maximum particle size of from about 10 Angstroms to about 1000 Angstroms and heating said formed intimate mixture at a temperature below the crystallization temperature of the metal alloy.

11. The substantially amorphous metal alloy object in accordance with claim 10 wherein said object has thicknesses in all dimensions greater than 50 $\mu$m.

12. The substantially amorphous metal alloy object in accordance with claim 10 wherein said ductile component is a material selected from the group comprising pure metal elements and metal solid solutions.

13. The substantially amorphous metal alloy object in accordance with claim 10 wherein said ductile component is a pure element selected from the group consisting of iron, nickel, copper, cobalt and tantalum.

* * * * *